US005839211A

United States Patent [19]

Pallera

[11] Patent Number: 5,839,211

[45] Date of Patent: Nov. 24, 1998

[54] NOVELTY SHOE

[75] Inventor: Jane Pallera, Arlington, Mass.

[73] Assignee: The Keds Corporation, Cambridge, Mass.

[21] Appl. No.: 343,201

[22] Filed: Nov. 22, 1994

Related U.S. Application Data

[63] Continuation of Ser. No. 116,358, Sep. 2, 1993, abandoned.

[51] Int. Cl.[6] ..... A43B 23/00

[52] U.S. Cl. ..... 36/136; 36/137

[58] Field of Search ..... 36/1, 132, 136, 36/137; 2/115, 209.13, 244, 245

[56] References Cited

U.S. PATENT DOCUMENTS

| | | | |
|---|---|---|---|
| 1,184,396 | 5/1916 | Trimble | 36/137 |
| 2,607,130 | 8/1952 | Pearson | 36/1 |
| 2,801,477 | 8/1957 | Adams et al. . | |
| 3,564,736 | 2/1971 | Cunningham . | |
| 3,997,184 | 12/1976 | Riti . | |
| 4,485,496 | 12/1984 | Shanks, Jr. | 2/247 |
| 4,516,337 | 5/1985 | Adamik | 36/136 |
| 4,611,416 | 9/1986 | Lin | 36/136 |
| 4,612,714 | 9/1986 | Gamm | 36/136 |
| 4,625,337 | 12/1986 | Zahn | 2/247 |
| 4,638,579 | 1/1987 | Gamm | 36/136 |
| 4,644,673 | 2/1987 | Gamm | 36/136 |
| 4,677,008 | 6/1987 | Webb . | |
| 4,697,362 | 10/1987 | Wasserman | 36/136 |
| 4,712,314 | 12/1987 | Sigoloff | 36/136 |
| 4,748,366 | 5/1988 | Taylor | 36/137 |
| 4,834,688 | 5/1989 | Jones | 2/115 |
| 4,837,960 | 6/1989 | Skaja | 36/136 |
| 4,852,276 | 8/1989 | Savoca et al. | 36/136 |
| 4,897,947 | 2/1990 | Kass-Pious | 36/136 |
| 4,963,117 | 10/1990 | Gualdoni | 446/219 |
| 5,029,700 | 7/1991 | Chen | 206/217 |
| 5,029,954 | 7/1991 | Eilrich et al. | 350/4.2 |
| 5,073,843 | 12/1991 | Magee . | |
| 5,092,807 | 3/1992 | Lew et al. | 446/159 |
| 5,105,940 | 4/1992 | Chen | 206/217 |
| 5,132,844 | 7/1992 | Sharp, Jr. . | |
| 5,136,726 | 8/1992 | Kellin et al. | 2/115 |
| 5,139,455 | 8/1992 | Israel . | |
| 5,173,968 | 12/1992 | Fox | 2/247 |
| 5,379,533 | 1/1995 | Swartz | 36/136 |

FOREIGN PATENT DOCUMENTS

| | | | |
|---|---|---|---|
| 9110376 | 7/1991 | WIPO | 36/29 |

*Primary Examiner*—M. D. Patterson
*Attorney, Agent, or Firm*—Fish & Richardson P.C.

[57] ABSTRACT

A shoe includes a sole, an upper mounted on the sole, and a display assembly. The display assembly includes an outer translucent member with a perimeter region fixedly attached to an outer surface of the upper and a central portion raised from a plane of the outer surface to provide a sealed compartment. A decorative element is disposed within the compartment and sized to move freely therewithin, the central portion of the outer translucent member permitting visual inspection of the decorative element within the compartment.

5 Claims, 2 Drawing Sheets

NOVELTY SHOE

This is a continuation of application Ser. No. 08/116,358, filed Sep. 2, 1993, now abandoned.

BACKGROUND OF THE INVENTION

The invention relates to footwear.

Shoes are fashioned in a wide variety of styles that provide comfort and support, as well as being aesthetically pleasing to the eye of the wearer. Logos, stylized designs and decorative marks are often placed on outer surfaces of the shoe. These may include embossed or debossed insignias for promoting the shoe manufacturer, and also may include display cards inserted behind a window attached to the outer portions of the shoe.

Zippered or snapped pockets have also been provided on external surfaces of footwear for storing personal items such as coins or keys.

SUMMARY OF THE INVENTION

According to the invention, a shoe has a sole, an upper mounted on the sole, and a display assembly comprising an outer translucent member with a perimeter region fixedly attached to an outer surface of the upper and a central portion raised from a plane of the outer surface to provide a sealed compartment; and a decorative element disposed within the compartment and sized to move freely therewithin, the central portion of the outer member permitting visual inspection of the decorative element within the compartment.

Preferred embodiments of the invention may include one or more of the following additional features. The display assembly further comprises an inner member with a perimeter region, the inner member and the outer translucent member sealed together along respective perimeter regions to form the sealed compartment. Preferably, the outer translucent member further comprises generally upstanding sidewalls extending about the central portion and between the central portion and the perimeter region. More preferably, the outer translucent member has a dome shape. The display assembly is joined to the upper by stitches. The decorative element disposed within the sealed compartment comprises a plurality of discrete luminescent elements containing a glow pigment for causing the elements to glow in the dark after being exposed in light for a sufficient period of time. The decorative element disposed within the sealed compartment comprises a picture. The decorative element disposed within the sealed compartment comprises a plurality of light reflective particles in a fluid medium. Preferably, the light reflective particles comprise sand and the fluid medium comprises oil.

The invention offers an effective way of providing decorative or promotional items which move freely within the space of the pouch on the outer portions of footwear. The invention is also entertaining, particularly to children, when the items placed in the sealed pouch are light reflective objects such as luminescent glow pieces or promotional pictures of celebrity or sport figures. Further, the use of reflective objects provides an element of safety to joggers when worn in the dark or in dimly lit conditions. Sealing the outer member to the inner member also allows the use of fluids and/or small particles within the compartment.

Other features and advantages of the invention will become apparent from the following description of a presently preferred embodiment, and from the claims.

DESCRIPTION OF THE PREFERRED EMBODIMENTS

Figure 1:
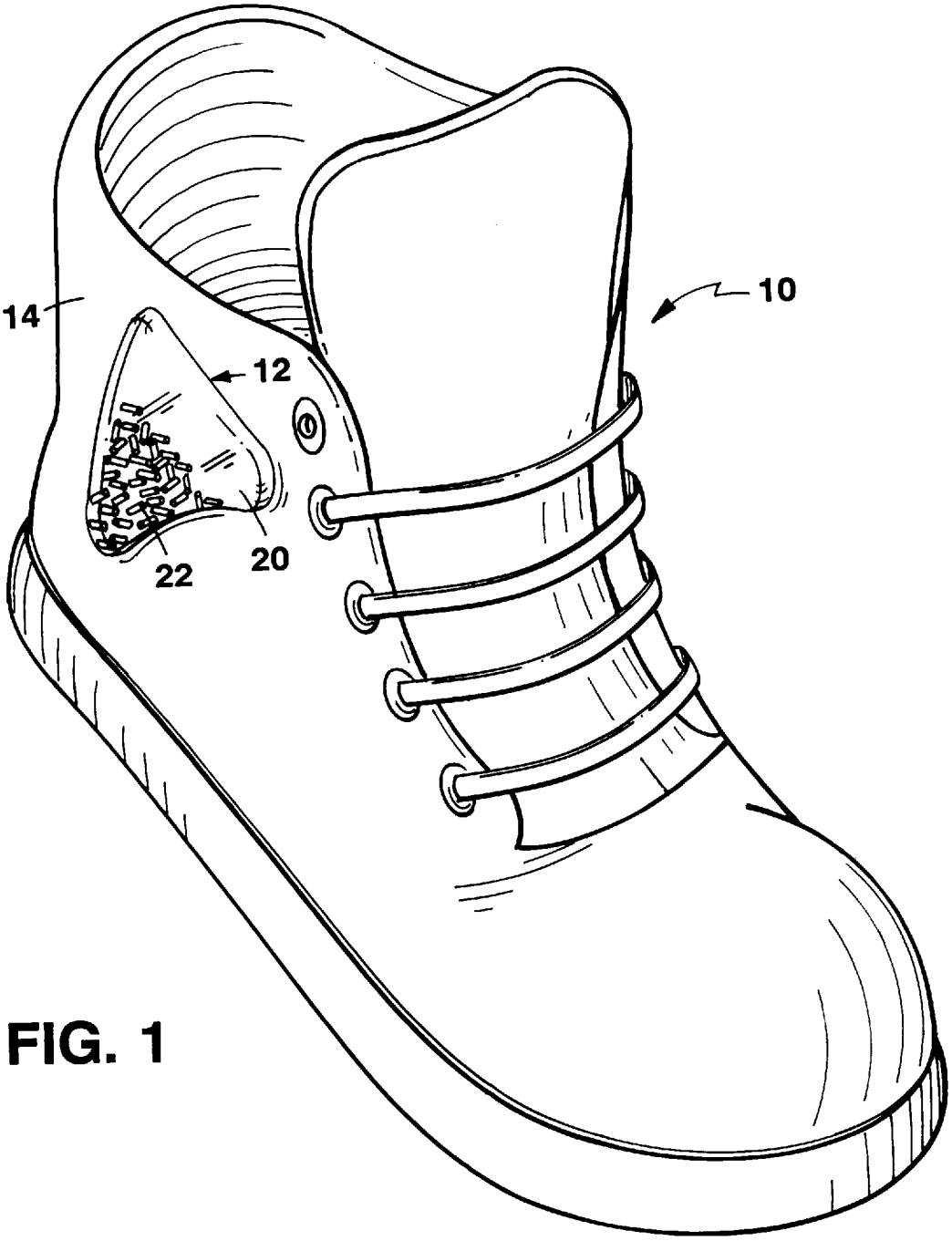
FIG. 1 is a perspective view of a shoe of the invention, according to the invention.

Referring to FIG. 1, a shoe 10 includes a sealed compartment or pouch 12 attached to an upper 14 of the shoe, e.g. by stitching. Upper 14 is preferably canvas or leather, but may be formed of any other suitable material.

Figure 2:
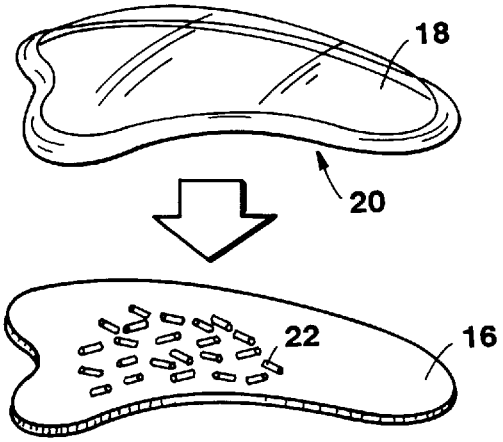
FIG. 2 is an exploded view of the display assembly of FIG. 1.

As shown in FIG. 2, sealed pouch 12 is formed from a flat plastic sheet 16 of arbitrary shape. A top plastic sheet 18 of similar shape is positioned over and permanently attached to flat piece 16 along the outer edges, e.g. with a heat sealing device. Top plastic sheet 18 has a rounded, dome shape having a predetermined height for providing an interior space 20 between the sheets at a central region of about 4.0 mm when attached. Both flat sheet 16 and top sheet 18 are transparent to allow visible access to the space 20 of the pouch.

Figure 3:
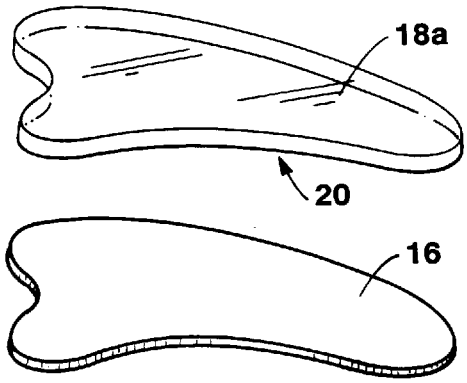
FIG. 3 is an exploded side view of an alternate embodiment of the sealed compartment of FIG. 1.

Prior to heat sealing the sheets 16, 18 together, decorative elements, e.g. small decorative or promotional articles are placed within the interior space. Compartment 12 is free of liquid. As shown in FIGS. 1–3, in one embodiment, a large number of discrete, luminescent glow pieces 22 are disposed within space 20, the pieces being sized to allow them to move freely in response to the walking motion of the wearer. Glow pieces 22 are extruded and cut into small cylindrical pieces from a polymer (e.g., polystyrene) rod having a glow pigment introduced during its manufacture so that the pieces 22, when exposed to light for a sufficient period, glow when placed in the dark.

Although top plastic sheet 18 is generally required to be transparent, or at least translucent, in nature to allow visible access to the articles placed within the pouch, it may be desirable that the flat plastic piece 16 be colored to provide contrast to the decorative elements.

The sealed region between sheets 16, 18 is attached to upper 14, e.g. using conventional shoe stitching techniques, or may alternatively be attached using other attachment methods, such as VELCRO® hook-and-loop type fasteners or adhesives.

Figure 4:
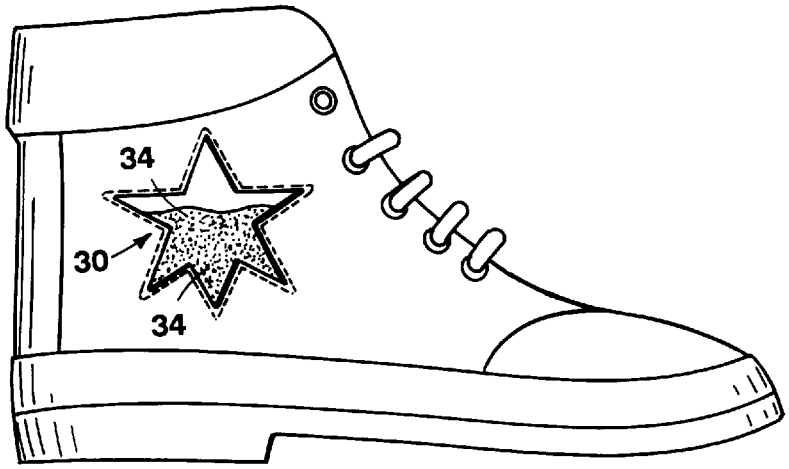
FIGS. 4 and 5 are side views of alternate embodiments of the invention.

Other embodiments are within the scope of the claims. For example, referring to FIG. 3, top plastic sheet **18*a* may have a more flattened construction with sidewalls 19 extending from top surface 21 of the sheet 18*a*. Also, as shown in FIG. 4, a star-shaped pouch 30 may be sewn to upper 14 of shoe 10. Pouch 30 is leak-tight to retain a mixture of sand 32 and oil 34 within the pouch. The oil 34** has a viscosity for retarding the shifting movement of the sand in response to the movement of the shoe.

Figure 5:
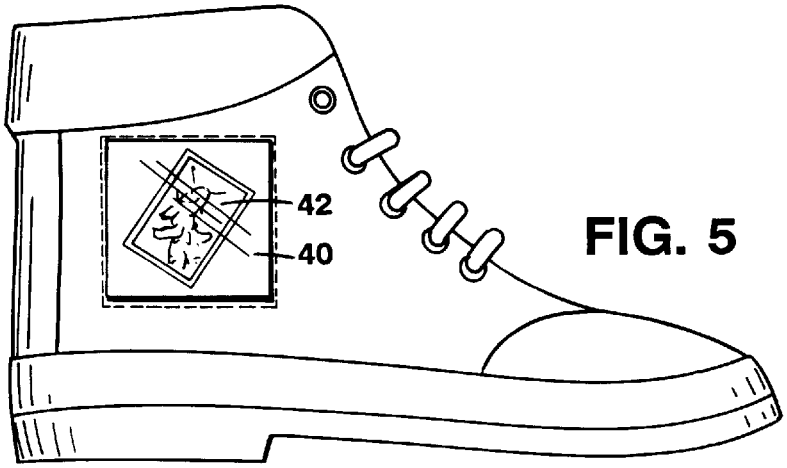

In another embodiment (FIG. 5), a rectangular shape pouch 40 contains a photograph 42. The photograph may show, e.g., a celebrity sports figure or cartoon character.

The shoe need not be a high-top sneaker, as shown, but may be any type of shoe, e.g., a casual shoe, running shoe or rainboot.

What is claimed is:

1. A shoe comprising a sole, a shoe upper mounted on the sole, and a display assembly attached upon an outer surface of said shoe upper, said display assembly comprising:

an outer member comprising a translucent wall at least partially defining a sealed compartment having an arbitrary shape that is defined by dimensions of width, thickness and length, said translucent wall comprising a central portion and generally upstanding sidewalls extending about the periphery of said central portion, said sealed compartment being free of liquid, and at least one solid decorative device disposed within said sealed compartment, said translucent wall permitting viewing of said at least one decorative device disposed within said sealed compartment, and said at least one solid decorative device having dimensions of width, thickness and length, the width of said at least one decorative device being significantly less than the width of the sealed compartment, the thickness of said at least one decorative device being significantly less that the thickness of said sealed compartment, and the length of said at least one solid decorative device being significantly less than the length of said sealed compartment, in a combined dimensional relationship selected to permit free movement of said solid decorative device within said sealed compartment.

2. The shoe of claim 1 wherein said outer translucent member has a dome shape.

3. The shoe of claim 1 wherein said display assembly is joined to the upper by stitches.

4. The shoe of claim 1 wherein said solid decorative device disposed within said sealed compartment comprises a plurality of discrete luminescent elements containing a glow pigment for causing said discrete luminescent elements to glow in the dark.

5. The shoe of claim 1 wherein said at least one solid decorative device disposed within said sealed compartment comprises a picture.

* * * * *